US006803526B2

(12) United States Patent
Chi-Sheng et al.

(10) Patent No.: US 6,803,526 B2
(45) Date of Patent: Oct. 12, 2004

(54) INSULATING DEVICE

(75) Inventors: Chen Chi-Sheng, Taoyuan Shien (TW); Hsieh Tung-Yun, Taoyuan Shien (TW)

(73) Assignee: Delta Electronics, Inc., Taoyuan Shien (TW)

( * ) Notice: Subject to any disclaimer, the term of this patent is extended or adjusted under 35 U.S.C. 154(b) by 0 days.

(21) Appl. No.: 10/404,897

(22) Filed: Mar. 31, 2003

(65) Prior Publication Data

US 2003/0184930 A1 Oct. 2, 2003

(30) Foreign Application Priority Data

Apr. 1, 2002 (TW) ..... 91204135 U

(51) Int. Cl.[7] ..... H01B 7/00
(52) U.S. Cl. ..... 174/138 G; 174/135
(58) Field of Search ..... 174/135, 137 R, 174/138 G, 152 G, 157, 163 R; 361/746, 752, 757, 758, 804

(56) References Cited

U.S. PATENT DOCUMENTS 4,266,267 A * 5/1981 Ruegg ..... 361/717
4,342,068 A * 7/1982 Kling ..... 361/717
4,546,408 A * 10/1985 Rodseth et al. ..... 361/720
4,587,377 A * 5/1986 Rodseth ..... 174/16.3
4,652,971 A * 3/1987 Peterson et al. ..... 361/720
4,886,940 A * 12/1989 Gagnon et al. ..... 174/88 B
4,987,511 A * 1/1991 Hopkinson et al. ..... 361/35
5,409,283 A * 4/1995 Ban ..... 296/35.1
5,921,589 A * 7/1999 Dubois ..... 285/49
6,104,143 A * 8/2000 Bonavia ..... 315/209 CD
6,121,766 A * 9/2000 Beardmore ..... 324/106
6,225,566 B1 * 5/2001 Dienst ..... 174/138 E
6,545,879 B1 * 4/2003 Goodwin ..... 361/807

* cited by examiner

*Primary Examiner*—Chau N. Nguyen
*Assistant Examiner*—Adolfo Nino

(57) ABSTRACT

An insulating device for insulating an electronic device having at least one hole and fixed on a metal case having at least one hole is provided. The insulating device includes a hollow insulating portion passing through the at least one hole of the metal case, a first insulating washer disposed on a first end of the hollow insulating portion, a second insulating washer disposed on a second end of the hollow insulating portion, and a fastening element passing through the first insulating washer, the second insulating washer and the at least one hole of the electronic device for fastening with the electronic device, so as to fix and insulate the electronic device against the metal case.

14 Claims, 4 Drawing Sheets

INSULATING DEVICE

FIELD OF THE INVENTION

The present invention relates to an insulating device, and more particularly to an insulating device primarily for insulating the current leakage of the electronic device.

BACKGROUND OF THE INVENTION

In a conventional electronic device, the outer shell of the electronic device is usually made of a metal for protecting the inner part of the electronic device. Although the outer shell made of a metal can strengthen the outer structure of the electronic device and protect the inner elements of the electronic device, it also induces the current leakage problem in the electronic device while the electronic device operates. That would reduce the life of the electronic device or other peripheral devices.

Please refer to FIG. 1. It is a schematic diagram illustrating a power factor regulator of the prior art. Typically, a power factor regulator includes a main body 1, a shell 2, and a cover 3. The shell 2 is used for containing the main body 1 inside. The shell 2 is made of metal and has two extended parts 11 which are extended from the bottom of the shell 2. Each of the extended parts further has plural threaded holes 22 for fastening the power factor regulator on a case (not shown in figure). However, the shell 2 of the power factor regulator, the extended parts 11 and the screws are all made of metals. Also, metal has good electric conduction property. Hence, the structure of the prior power factor regulator would induce the current leakage, and then damage the electronic device and the other peripheral devices. It is very dangerous for users. Furthermore, if the main board is also made of metal, the current leakage would be induced more seriously while the electronic device is fixed on the main board.

Therefore, it is tried to rectify this drawback and provide an electronic device having an insulating structure by the present applicant.

SUMMARY OF THE INVENTION

It is an object of the present invention to provide an insulating device for insulating an electronic device. At the same time, the insulating device can strengthen the structure thereof. In addition, the insulating device can prevent the electronic device from the current leakage situation while the electronic device is under operation.

According to an aspect of the present invention, the insulating device for insulating an electronic device is provided. The bottom of the electronic device is a metal plate. Two sides of the metal plate have at least one penetrating hole.

An insulating device for insulating an electronic device having at least one hole and fixed on a metal case having at least one hole includes a hollow insulating portion passing through said at least one hole of the metal case; a first insulating washer disposed on a first end of said hollow insulating portion; a second insulating washer disposed on a second end of said hollow insulating portion; and a fastening element passing through said first insulating washer, said second insulating washer and said at least one hole of said electronic device for fastening with said electronic device, so as to fix and insulate said electronic device against said metal case.

Preferably, at least one hole of the electronic device is disposed on two sides of a metal plate thereof.

Preferably, the electronic device is a transformer.

Alternatively, the electronic device is a power factor controller.

Preferably, the power factor controller further includes a coil ferrule and a magnetic core disposed in the coil ferrule.

Preferably, the coil ferrule is composed of an insulating material.

Preferably, the insulating device further includes an insulating cover disposed on the first insulating washer for covering and insulating the electrical device.

Preferably, the first insulating washer and the hollow insulating portion are of a unity.

Preferably, the hollow insulating portion and the second washer are of unity.

Preferably, the two sides of the plate have a plurality of the holes.

Preferably, the fastening element is a screw.

Alternatively, the fastening element is a bolt.

Preferably, the hollow insulating portion, the first insulating washer and the second insulating washer are made of an insulating material.

Preferably, the insulating material is made of plastics.

Preferably, a cross-section of the first insulating washer is bigger than that of the fastening element.

Preferably, a cross-section of the second insulating washer is bigger than that of the fastening element.

The foregoing and other features and advantages of the present invention will be more clearly understood through the following descriptions with reference to the drawings, wherein:

DETAILED DESCRIPTION OF THE PREFERRED EMBODIMENT

Figure 1:
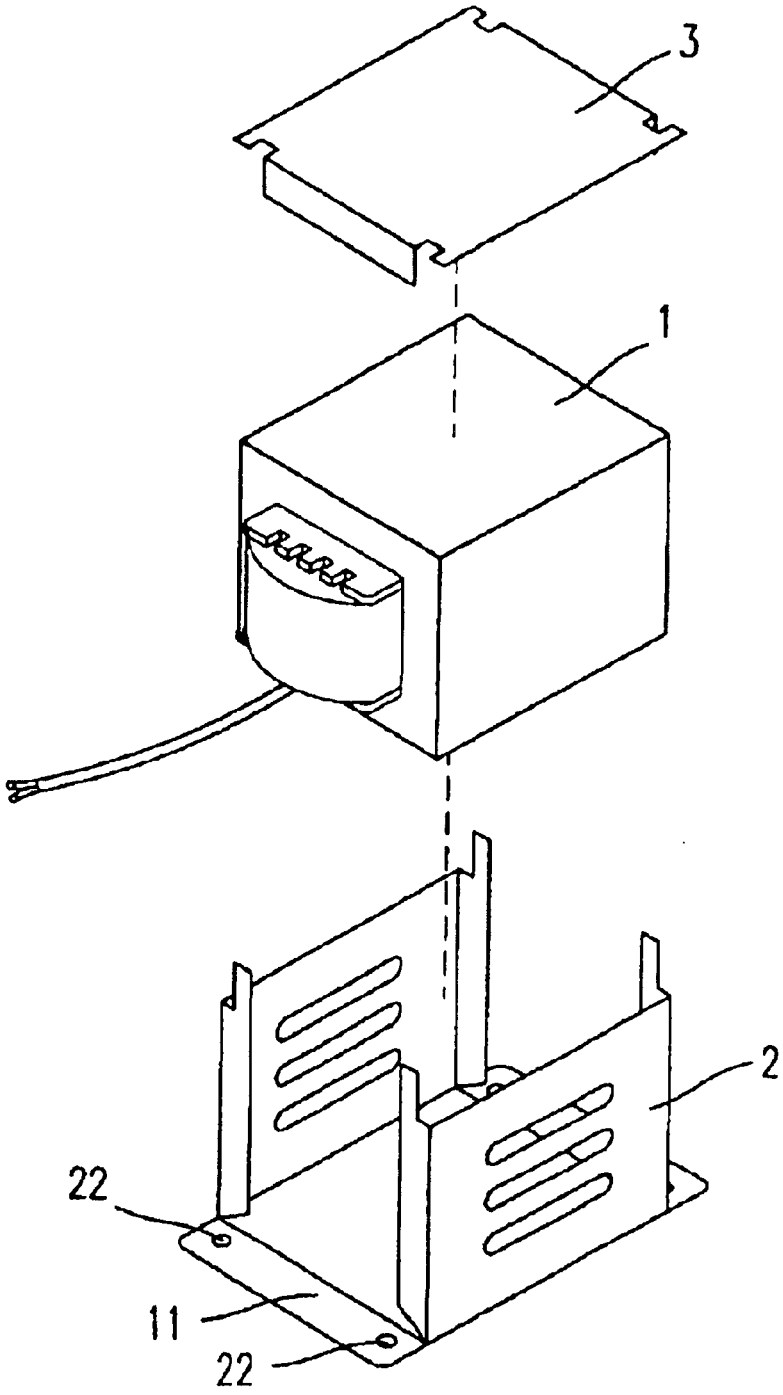
Fig. 1 (PRIOR ART)
FIG. 1 illustrates a power factor regulator of the prior art.
Figure 2:
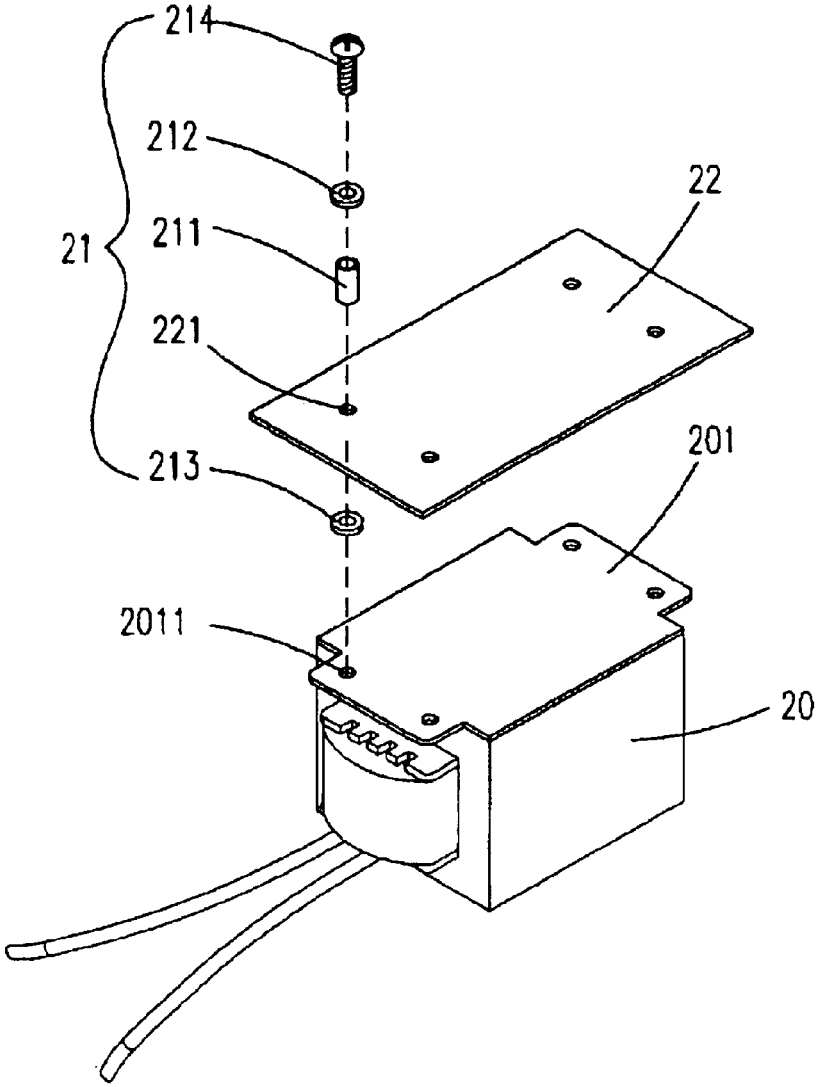
FIG. 2 illustrates a first preferred embodiment of the present invention of a power factor regulator.

Please refer to FIG. 2. FIG. 2 illustrates a preferred embodiment of the present invention of a power factor regular. In the present invention, the insulating device is applied to an electronic device. The electronic device having an insulating structure includes an main body 20 in which the bottom of the main body 20 is a metal plate 201, and the two sides of the plate 201 have at least one hole 2011 respectively. The insulating device at least includes a hollow insulating portion 211, a first insulating washer 212, a second insulating washer 213, and a fastening element 214. Meanwhile, the hollow insulating portion 211 penetrates through the hole 221 of a metal case 22. Moreover, the first insulating washer 212 is disposed on a first end of the hollow insulating portion 211, and the second insulating washer 213 is disposed on a second end of the hollow insulating portion 211. The fastening element 214 penetrates through the first insulating washer 212, the second insulating washer 213 and the hole 2011 of the metal plate 2011 for fastening the electronic device on the metal case 22. By means of insulating of the first insulating washer 212 and the hollow insulating portion 211, the main body 20 can be insulated from the fastening element 214 and the second insulating washer 213 can be insulated from the main body 20 and the metal case 22.

Meanwhile, the main body 20 usually is a transformer or a power factor controller. The power factor controller further includes a coil ferrule and a magnetic core, wherein the coil ferrule is composed of an insulating material. Considering the weight of the main body 20, the better fastening element 214 is a metal screw or bolt. Of course, it can be any plastic fastening element.

Accordingly, the metal plate 201 further includes plurality of the holes 2011 for containing more insulating devices 21 to dispose the main body 20 on the case 22 firmly. The better material of the hollow insulating portion 211 is plastic for further ensuring the insulation of the electronic device. Especially, the material of the hollow insulating portion can be plastic. When the fastening element 214 is engaged, the plastic will expand and full with the clearance of the hole 221, so as to dispose the main body 20 firmly.

Figure 3:
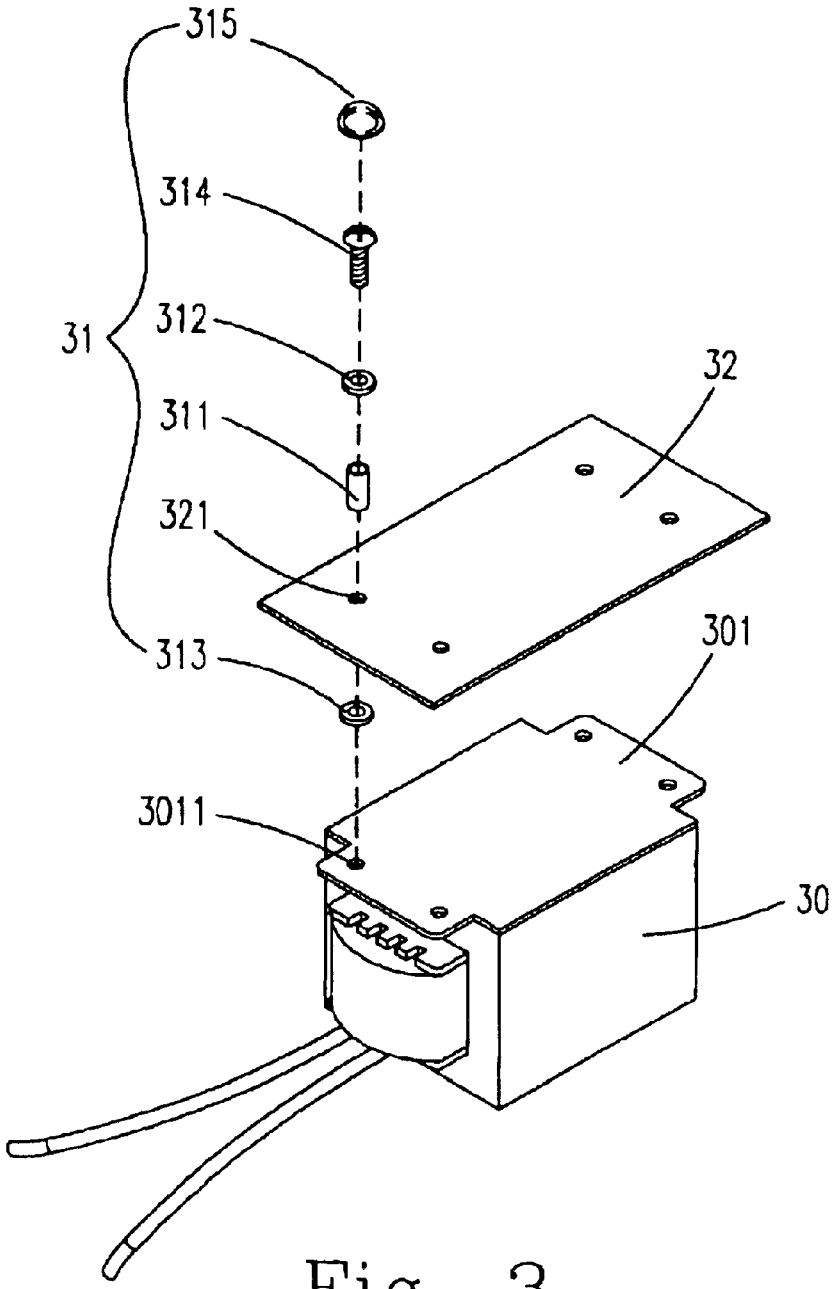
FIG. 3 illustrates a second preferred embodiment of the present invention of a power factor regulator.

Please refer to FIG. 3. FIG. 3 illustrates a second preferred embodiment of the present invention. The insulating device 31 further includes an insulating cover 315. When the electronic device 30 is disposed on the metal case 32, the insulating cover 315 covers on the fastening element 314 so as to insulate the fastening element 314 from outside, and thereby the electronic device 30 is insulated without the current leakage problem.

Figure 4:
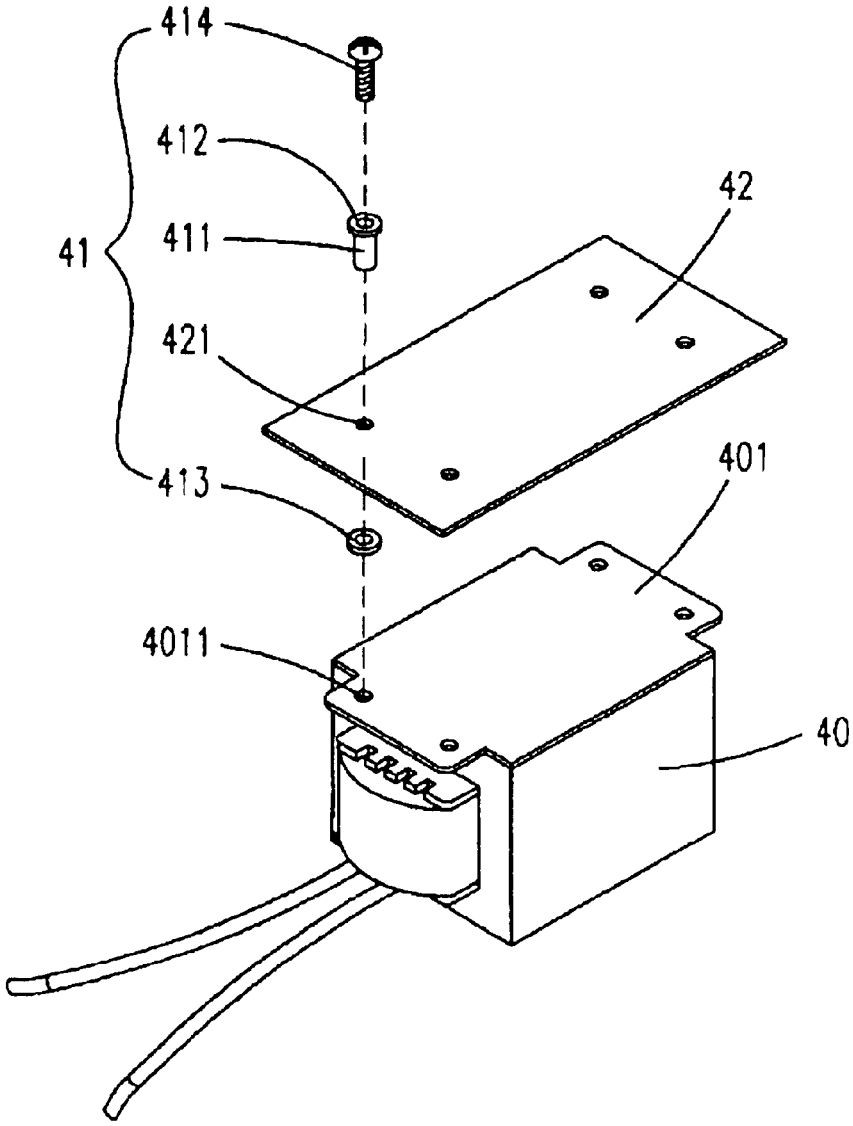
FIG. 4 illustrates a third preferred embodiment of the present invention of a power factor regulator.

Please refer to FIG. 4. It illustrates a third preferred embodiment of the present invention. The first insulating washer 412 and the hollow insulating portion 411 of the insulating device 41 are of a unity. This can simply the process of manufacturing the insulating device 41 and also reduce the cost of the molds and materials. Accordingly, the hollow insulating portion 411 and the second insulating washer 413 can be also of a unity to achieve the same goals.

Finally, the insulating device of the present invention having a metal plate which is fixed to the bottom of the electronic device can strengthen the structure of the electronic device. On the other hand, the fastening element fixes the electronic device on the mental case for completely protecting by the first insulating washer, the second insulating washer, and the hollow insulating portion. Thus, the insulating device of the present invention uses the completely protecting method for preventing the electronic device from current leakage problem. Accordingly, the insulating device of the present invention can accomplish the purposes of strengthening structure and insulating current, and then prevent the current leakage problem of the conventional electronic device.

While the invention has been described in terms of what are presently considered to be the most practical and preferred embodiments, it is to be understood that the invention need not to be limited to the disclosed embodiment. On the contrary, it is intended to cover various modifications and similar arrangements included within the spirit and scope of the appended claims which are to be accorded with the broadest interpretation, so as to encompass all such modifications and similar structures.

What is claimed is:

1. An insulating device for insulating an electronic device having at least one hole and fixed on a metal case having at least one hole, comprising:

a hollow insulating portion passing through said at least one hole of said metal case;

a first insulating washer disposed on a first end of said hollow insulating portion;

a second insulating washer disposed on a second end of said hollow insulating portion;

a fastening element passing through said first insulating washer, said second insulating washer, said hollow insulating portion and said at least one hole of said electronic device for fastening with said electronic device, so as to fix and insulate said electronic device against said metal case; and an insulating cover disposed on said fastening element for covering and insulating said fastening element.

2. The insulating device according to claim 1, wherein said at least one hole of said electronic device is disposed on two sides of a metal plate thereof.

3. The device according to claim 2, wherein said two sides of said plate have a plurality of said holes.

4. The device according to claim 1, wherein said electronic device is a transformer.

5. The device according to claim 1, wherein said electronic device is a power factor controller.

6. The device according to claim 5, wherein said power factor controller further comprises a coil ferrule and a magnetic core disposed in said coil ferrule.

7. The device according to claim 6, wherein said coil ferrule is composed of an insulating material.

8. The device according to claim 1, wherein said first insulating washer and said hollow insulating portion are of a unity.

9. The device according to claim 1, wherein said hollow insulating portion and said second insulating washer are of unity.

10. The device according to claim 1, wherein said fastening element is a screw.

11. The device according to claim 1, wherein said hollow insulating portion, said first insulating washer and said second insulating washer are made of an insulating material.

12. The device according to claim 11, wherein said insulating material is made of plastics.

13. The device according to claim 1, wherein a cross-section of said first insulating washer is bigger than that of said fastening element.

14. The device according to claim 1, wherein a cross-section of said second insulating washer is bigger than that of said fastening element.

* * * * *